United States Patent [19]

Tredwell et al.

[11] Patent Number: 4,702,174

[45] Date of Patent: Oct. 27, 1987

[54] CONVEYOR SYSTEM WITH SELECTIVELY DISENGAGEABLE CARTS

[75] Inventors: Gilman Tredwell; Kenneth N. Kraft, both of Evansville; Felix A. Ampon, Newburgh, all of Ind.

[73] Assignee: George Koch Sons, Inc., Evansville, Ind.

[21] Appl. No.: 833,170

[22] Filed: Feb. 27, 1986

[51] Int. Cl.[4] ..... B61B 10/04; B61K 7/02

[52] U.S. Cl. ..... 104/172.2; 104/249; 108/110

[58] Field of Search ..... 104/172 BT, 172 R, 172 B, 104/88, 141, 249, 250, 172.1, 172.2, 172.3; 108/54.1, 56.3, 11, 17, 19, 156, 159; 105/422; 198/465.1, 465.2, 803.01

[56] References Cited

U.S. PATENT DOCUMENTS

| | | | |
|---|---|---|---|
| 2,317,675 | 4/1943 | De Burgh | 104/172 B X |
| 2,640,607 | 6/1953 | De Burgh | 198/347 |
| 4,638,740 | 1/1987 | Rhodes | 104/172.2 |
| 4,644,869 | 2/1987 | Rhodes | 104/172.2 |

*Primary Examiner*—David A. Scherbel
*Assistant Examiner*—Scott H. Werny
*Attorney, Agent, or Firm*—Barnes & Thornburg

[57] ABSTRACT

A conveyor system for transporting items between specified work locations within a building is disclosed. The conveyor system includes a continuous guide track including a continuously moving drive chain and individual floor supported carts that move along the guide track. The individual carts have a retractable drive pin assembly that cooperates with disengaging rails mounted adjacent the guide track to allow the carts to stop at certain locations along the guide track. The individual carts have a retractable guide pin assembly that cooperates with selectively retaining means mounted thereon and cams mounted adjacent the guide track to retract the guide pin to allow the carts to be rotated at work stations or oriented in a sideways configuration to save space along the guide track. The carts also have a platform for supporting the items that is adjustable in height.

15 Claims, 13 Drawing Figures

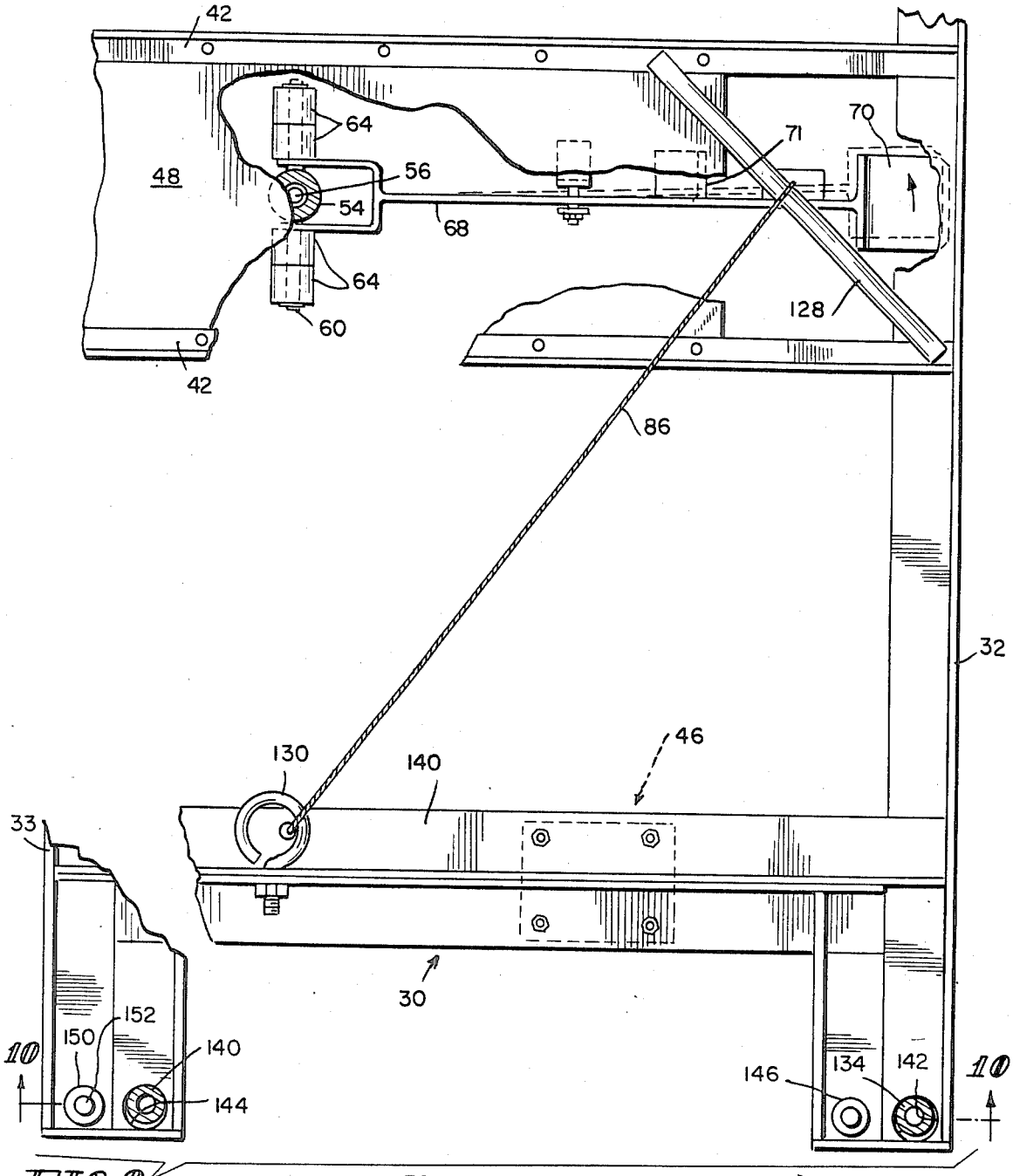
FIG. 9
FIG. 10
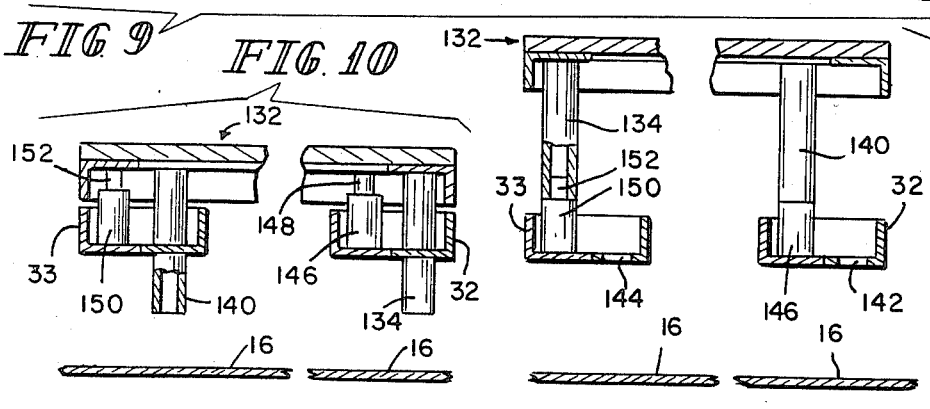
FIG. 11

CONVEYOR SYSTEM WITH SELECTIVELY DISENGAGEABLE CARTS

BACKGROUND AND SUMMARY OF THE INVENTION

The present invention relates to a conveyor system for transporting items between specified locations generally within the confines of a building over a specified path. Particularly, the present invention relates to a conveyor system for transporting items of manufacture between various assembly and work locations within a manufacturing and finishing plant. More particularly, the present invention relates to a conveyor system including individual work carrying carts that travel along a guide track that are selectively storable along the guide track at specified locations, and are completely removable from the guide track by the operator, if desired. The individual carts also have a platform that is adjustable in height for carrying the items.

Conveyors for transporting items of manufacture between different work stations are generally known. Two such conveyor systems are disclosed in U.S. Pat. Nos. 2,317,675 and 2,640,607 to DeBurgh. The known conveyor systems of this type have generally been elevated systems with substantially all of the components located above the floor. The systems include a continuously driven chain located within a continuous track, and individual carts that are moved along the track by the drive chain. The conveyor systems generally have a provision to store one or more carts in a storage position along the continuous track (close pack position).

One problem with the known conveyor systems is that because substantially all of the components for the system are located above the floor level, the floor and adjacent areas are highly obstructed.

Another problem with the known conveyor systems is that the carts or pallets are equipped with fixed drive rods (pallet pins) that extend vertically downward from the cart or pallet to engage the continuous drive chain. In order to allow the carts to remain stationary in the storage position, the drive chain must drop away from the drive rods attached to the carts. The track drops, or verticals, greatly increase the complexity of the drive chain apparatus, which in turn increases the cost of the entire system and are difficult to reposition.

Another problem with the known conveyor systems is that the carts or pallets are very difficult to remove from the track. In fact, in most of the known systems, the carts are generally not removable from the guide track under normal conditions. This greatly restricts the flexibility of the known conveyor systems.

Another problem with the known conveyor systems is that the individual carts or pallets have a product surface that is a fixed distance above the floor. This also greatly restricts the flexibility of the system because it makes the system more difficult to use for items with varying heights.

It is an object of the present invention to provide a conveyor system that has a minimum number of obstructions on the floor.

It is another object of the present invention to provide a conveyor system having a monoplane driving mechanism that remains substantially parallel to the path of movement of the conveyor carts and yet allows the carts to be disengaged from the drive mechanism at selected locations.

Yet another object of the present invention is to provide a conveyor system with carts that are easily removable from the conveyor track, at any point except storage locations along the track, when desired.

Yet another object of the present invention is to provide a conveyor system with carts that have an adjustable height platform, with the height adjustment being easily accomplished.

According to the present invention, an endless conveyor system is provided that includes individual floor supported carts that are adapted to roll along the path of a guide track. The guide track includes an endless drive means disposed within the guide track below the floor. Each individual cart includes a retractable guide means that moves between a retracted position and an extended position for engaging the guide track to guide the cart along the guide track. Each individual cart also includes a retractable engaging means that moves between a retracted position and an extended position for engaging the drive means to move the cart along the guide track. The conveyor system includes means for retracting the engaging means to stop the cart along the guide track. The conveyor system also includes means for retracting the guide means to allow the cart to be removed from the guide track.

Further, according to the present invention, the individual carts have an upper platform that includes leg means. The carts also have a lower frame with an upper surface and first support means that cooperate with the key means to support the platform at a first distance above the upper surface of the lower frame. The carts also have second support means that cooperate with the leg means to support the platform a second distance above the upper surface of the lower frame.

In preferred embodiments of the present invention, the engaging means is a retractable drive pin assembly that includes a drive pin that is spring biased to the extended position and a drive cam roller attached to the drive pin. The drive cam roller cooperates with an inclined drive cam mounted adjacent the guide track to force the pusher pin to the retracted position. One feature of the foregoing structure is that because the drive pin is retractable, the drive means can be monoplane (parallel to the floor), and the drive means can still be disengaged from the drive pin as desired. One advantage of this feature is that the drive means is much simpler to construct, and is less complicated, which increases its reliability. Another feature of the foregoing structure is that the drive pin is easily disengageable from the drive means at selected positions along the guide track. The selected positions can be changed to meet new requirements merely by relocating the drive cams. One advantage of this feature is that the cart is easily removable from the guide track after the drive pin is forced to the retracted position, if the guide means is also disengaged from the guide track.

Also in preferred embodiments of the present invention, the guide means is a retractable guide pin assembly that includes a guide pin that is spring biased to the extended position and a guide cam roller attached to the guide pin. Also included in the guide pin assembly is a retaining means to adequately retain the guide pin in the retracted position. The guide cam roller cooperates with an inclined guide cam mounted adjacent the guide track to force the guide pin to the retracted position. The retaining means then keeps the guide pin in the retracted position unless the retaining means is disengaged. One feature of the foregoing structure is that the guide pin is easily disengageable from the guide track at selected positions along the guide track. The selected positions can be changed to meet new requirements merely by relocating the guide cams. One advantage of this feature is that the cart can be reoriented in relation to the guide track when the guide pin is retracted. This allows the carts to be stacked together in the minimum required space along the guide track. The carts can also be removed from the guide track easily if both the guide pin and the drive pin are retracted.

Also in preferred embodiments of the present invention, operator activated, manual retracting means is provided to manually retract both the guide pin and the drive pin. One feature of the foregoing structure is that the guide pin and the drive pin can be simultaneously retracted by the operator by simply depressing the manual retracting means. One advantage of this feature is that the cart can be easily removed from the guide track by the operator at any position other than the storage locations (close pack) along the guide track at the choosing of the operator.

Also in preferred embodiments of the present invention, the first support means on the lower frame of the cart includes four mounting pins and the leg means on the upper platform includes four tubular legs. The second support means includes a portion of the lower frame formed to include four holes. One feature of the foregoing structure is that when the upper platform is in one orientation, the mounting pins cooperate with the tubular legs to support the upper platform a first distance above the lower frame. When the upper platform is in a second orientation, the four holes receive the four legs so that the lower frame itself supports the upper platform. Thus the upper platform has two working levels. One advantage of this feature is that the carts are adaptable to carry different sized items at the proper working level. This eliminates the need for different carts for differently sized items, thereby lowering the overall cost of the conveyor system.

Additional objects, features, and advantages of the invention will become apparent to those skilled in the art upon consideration of the following detailed description of a preferred embodiment exemplifying the best mode of carrying out the invention as presently perceived. The detailed description particularly refers to the accompanying figures in which:

BRIEF DESCRIPTION OF THE DRAWINGS

FIG. 9 is a fragmentary plan view taken along lines 9—9 of FIG. 2 with portions broken away;

FIG. 10 is a fragmentary plan view taken along lines 10—10 of FIG. 9 with the platform in the lower position;

FIG. 11 is a view similar to FIG. 10 with the platform in the higher position;

DETAILED DESCRIPTION OF THE DRAWINGS

Figure 1:
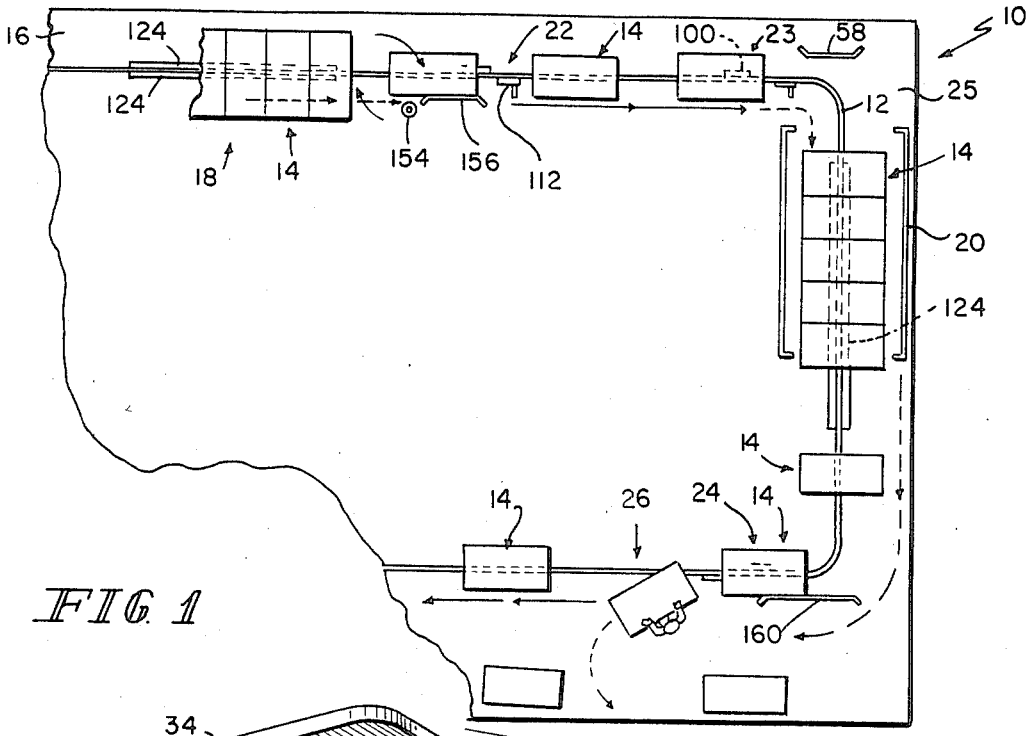
FIG. 1 is a diagrammatic plan view of a portion of a conveyor system of the present invention.

Referring now to the drawings and specifically to FIG. 1, a conveyor system 10 is shown that includes a continuous guide track 12, only a portion of which is shown. A series of individual carts 14 are positioned on the guide track 12 for movement therealong. The construction of the carts 14 will be described later. The guide track 12 is mounted in the floor 16 of a conventional manufacturing and finishing plant that is not shown in detail.

The conveyor system 10 includes the provision to temporarily store some of the carts 14 in a sideways orientation ("close pack") as shown at positions 18 and 20 of FIG. 1. The conveyor system 10 also includes the provision to orient the carts 14 such that they are aligned with the guide track 12 as shown at positions 22 and 24. The conveyor system 10 also includes the provision to individually remove the carts 14 from the guide track 12 as shown at position 26. Each of these orientations will be discussed later in more detail.

Figure 2:
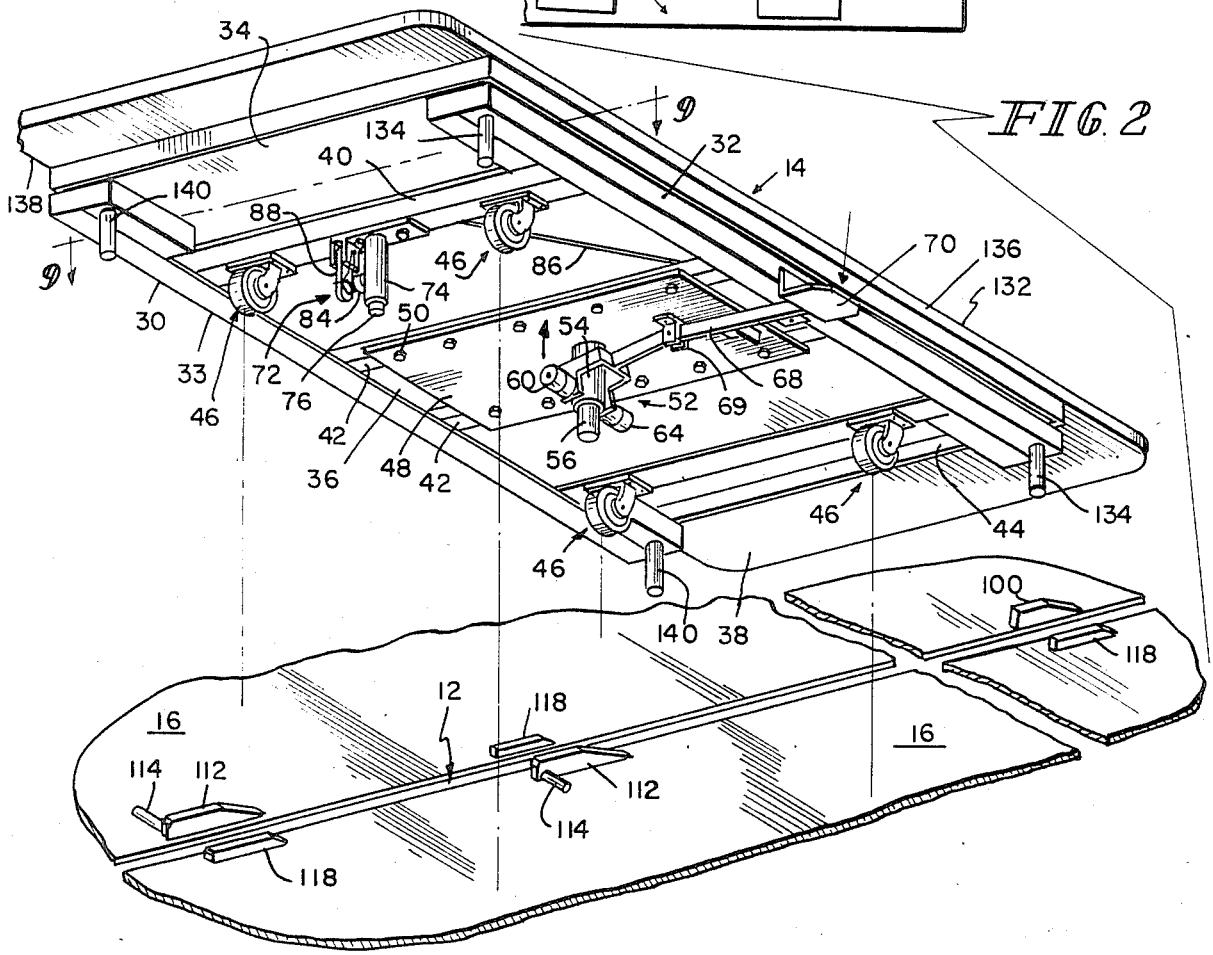
FIG. 2 is a perspective view of a cart separated from the guide track.

Referring now to FIG. 2, the cart 14 is shown in detail. Each cart 14 includes a frame 30 having side members 32, 33. The cart 14 has a front portion 34, a center portion 36, and a rear portion 38. A cross member 40 is mounted transversely between the two side members 32, 33 near the front portion 34 of the cart 14. Two cross members 42 are mounted transversely between the two side members 32, 33 near the center portion 36 of the cart 14. A cross member 44 is mounted transversely between the two side members 32, 33 near the rear portion 38 of the cart 14.

Four swivel wheels 46 are attached to the cart 14 to allow the cart 14 to roll along the floor 16. Two of the wheels 46 are attached to the front cross member 40, and two of the wheels 46 are attached to the rear cross member 44, as shown in FIG. 2.

Figure 7:
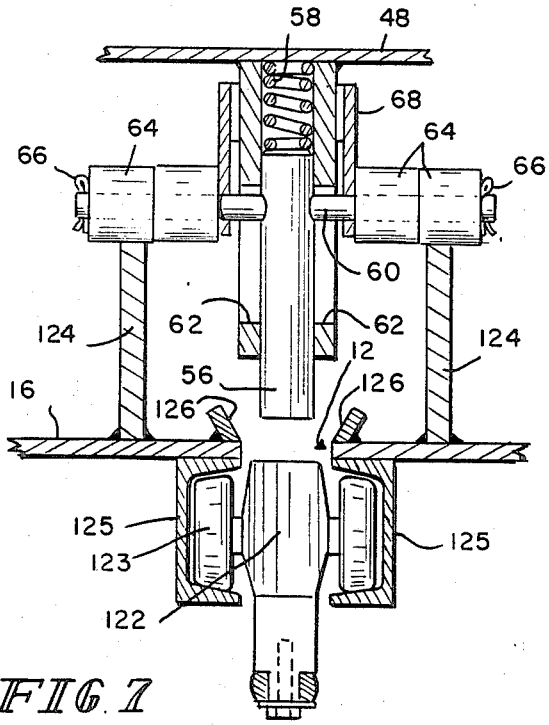
FIG. 7 is a view taken along lines 7—7 of FIG. 6.
Figure 8:
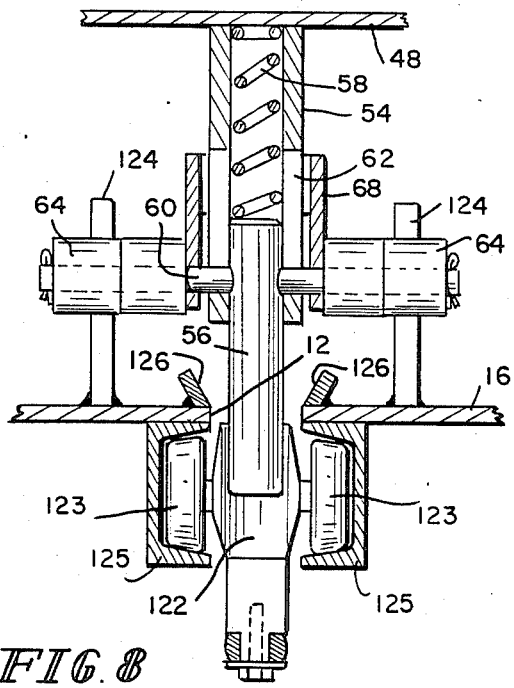
FIG. 8 is a view similar to FIG. 7 with the drive pin extended to be in contact with the drive chain.

A plate 48 is attached to the two center cross members 42 by bolts 50 or the like. A retractable drive pin assembly 52 is attached to the underside of the plate 48 and extends downwardly toward the guide track 12. The drive pin assembly 52 includes a drive pin housing 54. A drive pin 56 is inserted into the drive pin housing 54 for movement therein between a retracted position and an extended position. A spring 58 is fitted within the drive pin housing 54 between the top of the drive pin 56 and the plate 48 to yieldably bias the drive pin 56 downwardly to the extended position. The spring 58 is best shown in FIGS. 7 and 8.

A transversely mounted support rod 60 extends through the drive pin 56 and extends radially outwardly through elongated vertical slots 62 in the drive pin housing 54. Two drive pin cam rollers 64 are mounted on each end of the support rod 60 on either side of the drive pin housing 54 and are held in place by cotter pins 66, or other suitable fasteners.

Figure 6:
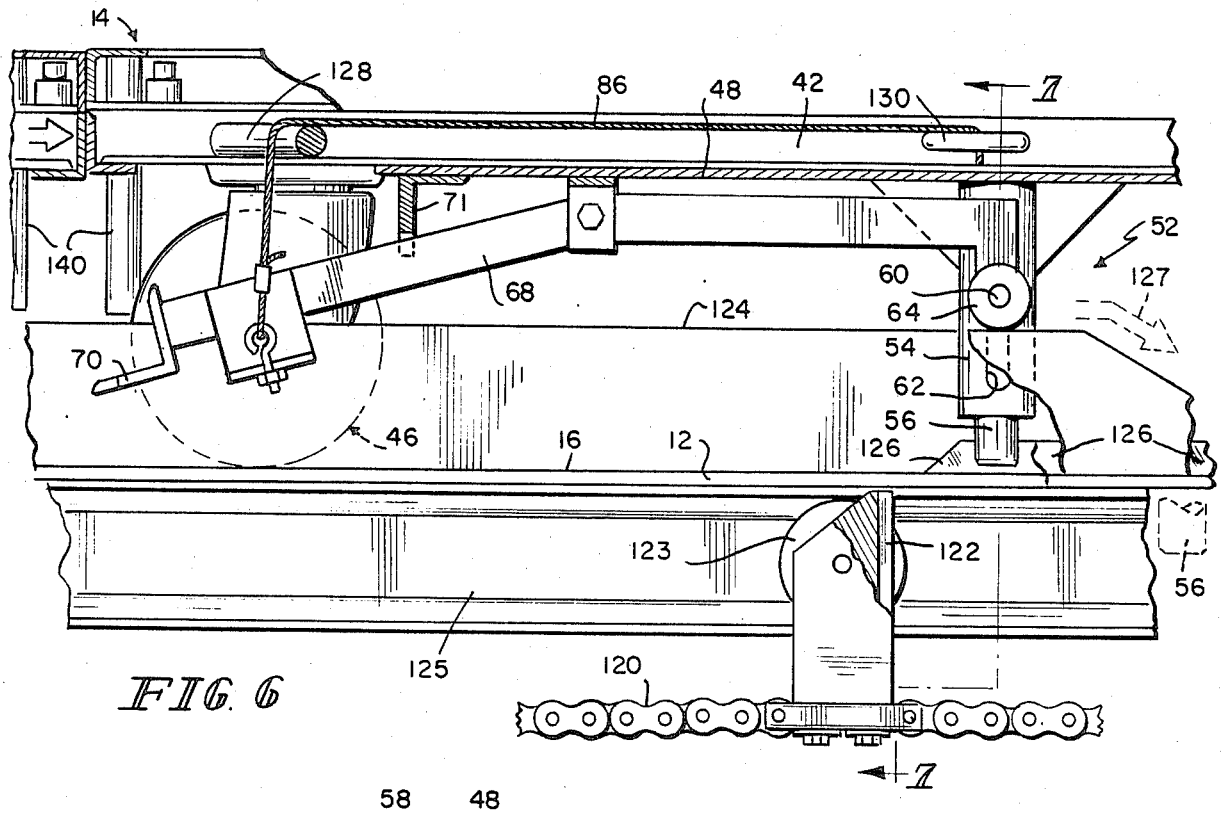
FIG. 6 is a transverse section showing the cart and the center of the guide track with the cart oriented transversely to the guide track.

A foot-operated release bar 68 is pivotally mounted near its center by a bracket 69 to the plate 48. One end of the release bar 68 is formed to provide a foot pedal 70, whereas the opposite end of the release bar 68 is attached to the support rod 60. The release bar 68 is used to raise the drive pin 56 to its upward retracted position when the foot pedal 70 is depressed downwardly by an operator. The foot pedal 70 is releasably retained in the depressed position by a locking device 71 (FIG. 6).

A retractable guide pin assembly 72 is attached to the cross member 40 near its center and extends downwardly toward the guide track 12. The guide pin assembly 72 includes a guide pin housing 74. A guide pin 76 is inserted into the guide pin housing 74 for movement therein between a retracted position and an extended position. A spring 78 (FIG. 4) is fitted within the guide pin housing 74 between the top of the guide pin 76 and the cross member 40 to yieldably bias the guide pin 76 downwardly to the extended position.

A transversely mounted support rod 80 is attached by one of its ends to the guide pin 76 and extends radially outwardly through an elongated vertical slot 82 (FIG. 4) in the guide pin housing 74. A guide pin cam roller 84 is rotatably mounted on the support rod 80.

Figure 4:
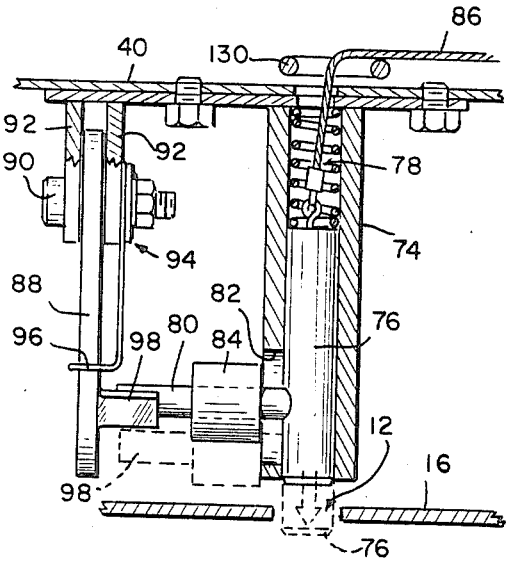
FIG. 4 is a right side elevation of FIG. 3*a* with portions broken away.

A cable 86 (FIG. 4) is attached conventionally at one of its ends to the top of the guide pin 76, with the other end attached conventionally and adjustably to the release bar 68 such that when the foot pedal 70 is depressed, the cable 86 pulls the guide pin 76 upwardly to its retracted position, as shown in FIG. 4.

Referring now to FIG. 6, a conventional continuous drive chain 120 is shown disposed within the guide track 12. Conventional pusher dogs 122 are attached to the drive chain 120. Rollers 123 are attached to each pusher dog 122 that ride in channels 125 as best shown in FIGS. 7 and 8. The pusher dogs 122 are positioned so that when the drive pin 56 is in the extended position, one pusher dog 122 will contact the drive pin 56 to move the cart 14 along the guide track 12. As can be seen in FIG. 8, when in the extended position, the drive pin 56 extends downwardly into the guide track 12 a distance sufficient to come into contact with the pusher dog 122. It will be understood that although the guide pin 76 extends downwardly into the guide track 12 when in the extended position, the guide pin 76 does not extend into the guide track 12 a distance sufficient to contact the moving pusher dogs 122. Thus, although both the drive pin 56 and the guide pin 76 may extend into the guide track 12 at the same time, only the drive pin 56 will act to move the cart 14.

Figure 5:
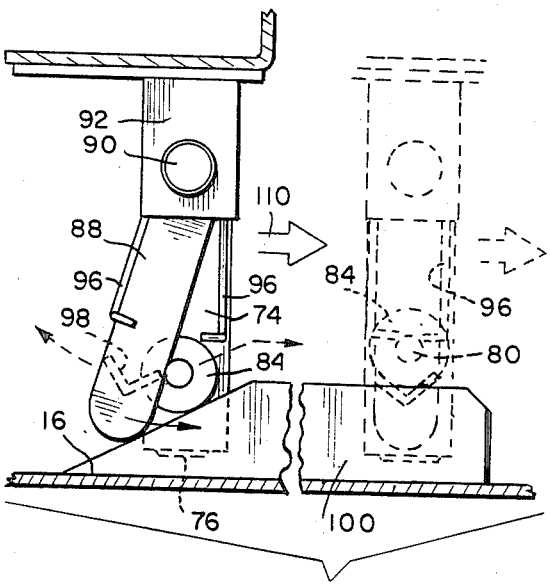
FIG. 5 is a side elevational view of the guide pin assembly in contact with the disengaging floor cam.

A trip arm 88, best shown in FIGS. 4 and 5, is pivotally mounted adjacent to the guide pin assembly 72 and extends downwardly substantially the same distance as the guide pin housing 74. The trip arm 88 pivots about a bolt 90 that extends through a bracket 92 attached to the cross member 40. A coil spring 94 (FIG. 4) having depending biasing arms 96 is mounted around the bolt 90 with the biasing arms 96 extending downwardly to embrace both edges of the trip arm 88. The coil spring 94 acts as a self centering mechanism to yieldably bias the trip arm 88 to the vertical position. It will be understood that the trip arm 88 would normally be biased to the vertical position without the coil spring 94 by gravity, however the coil spring 94 provides additional biasing force and minimizes movement caused by surges in the drive chain 120.

A saddle 98 is attached near the lower edge the trip arm 88. The saddle 98 is oriented to engage the support rod 80 supporting the guide pin cam roller 84 when the trip arm 88 is in the vertical position. When the support rod 80 is engaged in the saddle 98, the guide pin 76 will be held in the retracted position, as shown in FIG. 4.

Disengaging floor cams 100 (FIG. 5) are mounted on the floor 16 adjacent the guide track 12 at selected locations, only one of which is shown. The disengaging floor cams 100 are positioned to engage the guide pin cam roller 84 of the guide pin assembly 72. As the cart 14 moves in the direction indicated by arrow 110 (FIG. 5), the guide pin cam roller 84 will roll up the disengaging floor cam 100 to move the guide pin 76 to the retracted position. The support rod 80 will initially contact the outer surface of the saddle 98 to deflect the trip arm 88 from the vertical position so the support rod 80 and attached guide pin cam roller 84 can continue upwardly. The coil spring 94 will then urge the trip arm 88 back to its vertical position as shown in dotted line in FIG. 5. Continued movement of the cart 14 in the direction of arrow 110 will cause the guide pin cam roller 84 to roll off of the disengaging floor cam 100, and the support rod 80 will be forced into the saddle 98 by the biasing force of the spring 78 The guide pin 76 is then held in the disengaged, retracted position.

Engaging floor cams 112 (FIG. 3*b*) are also mounted on the floor 16 adjacent the guide track 12 at other selected positions, only one of which is shown. The engaging floor cam 112 differs from the disengaging floor cam 100 only by the addition of a repositioning bar 114 mounted on the engaging floor cam 112. The engaging floor cam 112 cooperates with the guide pin assembly 72 to cause the guide pin 76 to be engaged in the guide track 12.

Figure 3A:
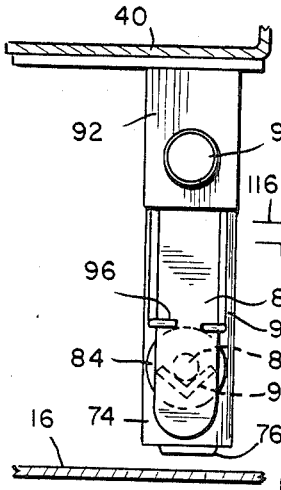
FIG. 3*a* is a side elevational view of the guide pin assembly with the guide pin in the retracted position.
Figure 3B:
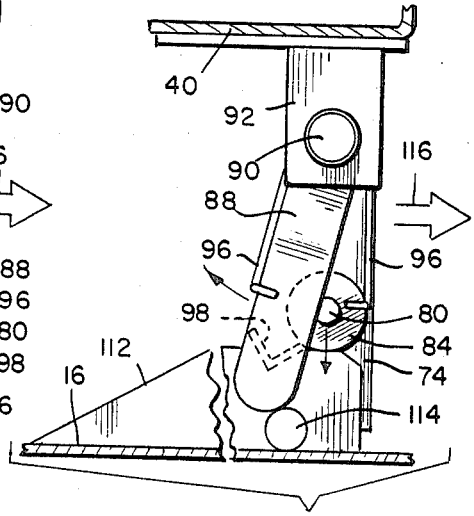
FIG. 3*b* is a side elevational view of the guide pin assembly in contact with the engaging floor cam.
Figure 3C:
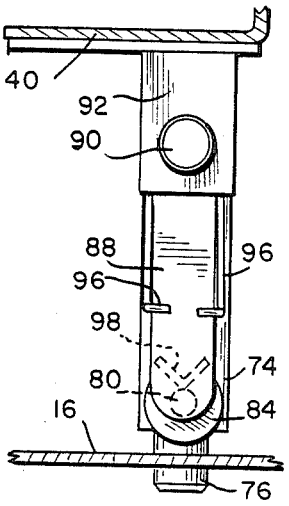
FIG. 3*c* is a side elevational view of the guide pin assembly with the guide pin in the extended position.

As shown in FIGS. 3*a*, 3*b*, and 3*c*, when the cart 14 is moving in the direction indicated by arrows 116, the support rod 80 is initially engaged in the saddle 98 to hold the guide pin 76 in the retracted position. The guide pin cam roller 84 then contacts the engaging floor cam 112 which raises the support rod 80 out of the saddle 98. Before the guide pin cam roller 84 rolls off of the edge of the engaging floor cam 112, the repositioning bar 114 contacts the trip arm 88 and forces it away from the vertical position as shown in FIG. 3*b*. Thus, as the guide pin cam roller 84 rolls off the edge of the engaging floor cam 112, the support rod 80 and guide pin 76 are forced downwardly by the force of the spring 78 and the guide pin 76 goes to the extended position in which it is engaged in the guide track 12 as shown in FIG. 3*c*.

Guide blocks 118 may be mounted on the opposite side of the guide track 12, directly opposed to the floor cams 100, 112, as shown in FIG. 2. The guide blocks 118 are designed to contact the guide pin housing 74 to aid in keeping the cart 14 and guide pin assembly 72 aligned so that when the guide pin cam roller 84 rolls off the edge of the floor cams 100, 112, the guide pin 76 will be directly over the guide track 12.

Disengaging rails 124 are mounted on both sides of the guide track 12 to engage the drive pin cam rollers 64 at certain locations along the guide track 12. The drive pin cam rollers 64 roll up the edge of the disengaging rails 124 and thereby raise the drive pin 56 to the retracted position, as shown in FIG. 7.

Flanges 126 are mounted on both edges of the guide track 12 and extend upwardly and outwardly from the guide track 12 to form a generally V-shaped opening into the guide track 12. As the drive pin cam rollers 64 roll off of the ends of the disengaging rails 124, in the direction of the dotted arrow 127 in FIG. 6, the flanges 126 help to guide the drive pin 56 into the guide track 12 so that the drive pin 56 can interface with the pusher dogs 122 of the drive chain 120.

FIG. 6 also shows in more detail the release bar 68 and the cable 86. The cable 86 is attached conventionally to the release bar 68 at a point near the foot pedal 70. The cable 86 is routed over a roller mechanism 128 mounted on the frame 30 of the cart 14 and then passes through an eye-shaped bolt 130. The cable 86 then is attached conventionally to the top of the guide pin 76, as shown in FIG. 4. Depressing the foot pedal 70 raises the drive pin 56 directly, and raises the guide pin 76 via the cable 86. With both the drive pin 56 and the guide pin 76 disengaged from the guide track 12, the cart 14 can be removed from the guide track 12 as illustrated in position 26 in FIG. 1.

Referring again to FIG. 2, the cart 14 further includes an upper platform 132 that serves as the working surface of the cart 14. The platform 132 is formed conventionally from plywood, however it is understood that any other suitable material could be used. The platform 132 has a first edge 136 (FIG. 2) and a second edge 138 opposite the first edge 136.

A pair of legs 134 are attached to the underside of the platform 132 near the first edge 136 that extend downwardly and are perpendicular to the platform 132. Another pair of legs 140 are attached to the underside of the platform 132 near the second edge 138, however the legs 140 are inset from the second edge 138 a distance greater than the distance that the legs 134 are inset from the first edge 136, as best shown in FIG. 2.

Holes 142 are formed in the side member 32 of the frame 30 near its ends, only one of which is shown in FIG. 9. The holes 142 are sized to receive the legs 134 of the platform 132. Holes 144 are formed in the side members 33 of the frame 30 near its ends, only one of which is shown. The holes 144 are identical in size to holes 142, however holes 144 are located a greater distance from the side member 33 than the distance the holes 142 are from the side member 32 (FIG. 9). The location of the holes 142, 144 corresponds to the location of the legs 134, 140 on the platform 132 such that when the platform 132 is oriented as shown in FIG. 2, the legs 134, 140 will extend through the holes 142, 144, respectively, and the platform will be in a position substantially adjacent the frame 30. This orientation is best shown in FIG. 10.

Supports 146 are attached to the side member 32 near its ends and extend upwardly, only one of which is shown in FIG. 9. The supports 146 have reduced diameter portions 148 that are sized to be inserted into the tubular legs 140. Supports 150 are attached to the side member 33 near its ends and extend upwardly, only one of which is shown in FIG. 9. The supports 150 have reduced diameter portions that are sized to be inserted into the tubular legs 134. To mate the supports 146 and 150 with legs 140 and 134, respectively, the platform 132 must be lifted upwardly away from the frame 30 and then rotated 180°, end for end, so that the first edge 136 is aligned with the side member 33, and the second edge 138 is aligned with the side member 32. The platform 132 is then lowered so that the legs 140 and 134 are fitted onto the supports 146 and 150. In this position, the platform 132 will be supported somewhat above the frame 30 to raise the platform 132 further from the floor 16, which is advantageous for some applications. This higher orientation of the platform 132 is best shown in FIG. 11.

In operation of the system, illustratively, a series of carts 14 are shown at position 18 in FIG. 1 in the "close pack" condition, where the carts 14 are sideways and where the drive pin 56 and the guide pin 76 are in the retracted position and disengaged from the guide track 12. As discussed previously, the drive pin 56 is disengaged by the interaction of the drive pin cam rollers 64 with the disengaging rails 124. It will be understood that the disengaging rails 124 extend along only a portion of the guide track 12. It will be further understood that because the drive pin 56 of each cart 14 in the "close pack" condition is disengaged, the carts 14 will not move along the guide track 12 until the cart 14 closest to the exiting end of the disengaging rails 124 is forced past the disengaging rails 124 by another cart 14 entering the "close pack."

As the cart 14 closest to the exiting end of the disengaging rails 124 is forced forward, the drive pin 56 will drop to its extended position as discussed previously, and the cart will begin to move forward as the pusher dog 122 engages the drive pin 56. The cart 14 will be turned by a conventional turning post 154 to an orientation in which it is aligned with the guide track 12. A guide rail 156 mounted parallel to the guide track 12 aids in this alignment, as shown at position 22 in FIG. 1.

As the cart 14 continues forward, the guide pin assembly 72 comes into contact with the engaging floor cam 112 to cause the guide pin 76 to become engaged in the guide track 12, as described previously, so that the cart 14 will roll down the guide track 12 in the proper alignment. As the cart reaches position 23, the guide pin assembly 72 comes into contact with the disengaging floor cam 100, as described previously, to disengage the guide pin 76 from the guide track 12. This disengagement is necessary to turn the cart 14 sideways to enter the next "close pack" condition or to allow a cart 14 to be rotated freely at work stations. With the guide pin 76 disengaged, the cart 14 is turned into a sideways orientation by a guide rail 158 at position 25. Because the drive pin 56 is still engaged with the pusher dog 122 of the drive chain 120, the cart 14 continues to move forward in a sideways orientation and enters the "close pack" condition at position 20. The drive pin cam rollers 64 then engage the disengaging rails 124 to disengage the drive pin 56 from the drive chain 120 which causes the cart 14 to stop moving. In its movement into the "close pack" condition, the cart 14 has forced another cart 14 out of the "close pack" condition, with the displaced cart 14 then proceeding toward position 24.

At position 24, the cart 14 is again aligned with the guide track 12 by a guide rail 160. The guide pin assembly 72 then comes into contact with an engaging floor cam 112 which causes the guide pin 76 to become engaged in the guide track 12. The cart 14 will then continue down the guide track 12 as described previously. It will be understood that any combination of "close pack" locations can be placed along the guide track 12. It will also be understood that the above description is illustrative only, and describes only a portion of a continuous guide track 12.

An operator can manually depress the foot pedal 70 of the release bar 68 and latch it in position to disengage both the drive pin 56 and the guide pin 76 from the guide track 12. The cart 14 can then be manually removed from the guide track 12 for off-line activities. This process is illustrated at position 26 in FIG. 1. It will be understood that additional carts 14 can be placed onto the guide track 12 by reversing the above procedure. The carts 14 may be placed onto the guide track 12 in an orientation where the guide pin assembly 72 is either ahead or behind the drive pin assembly 54 with respect to the direction of movement. The guide pin assembly 72 will cooperate with the disengaging floor cams 100 and the engaging floor cams 112 in either orientation because identical cams 100, 112 are placed on opposite sides of the guide track 12, as shown in FIG. 2.

Although the invention has been described in detail with reference to preferred embodiments and specific examples, variations and modifications exist within the scope and spirit of the invention as described and defined in the following claims.

We claim:

1. An endless conveyor system having individual, rolling, work carrying carts supported on a floor, the conveyor system comprising:

a guide track mounted in the floor;

an endless drive means in said guide track;

retractable guide means attached to each of said individual carts and movable between an extended position and a retracted position for engaging said guide track to guide said carts along said guide track when the guide means is in the extended position;

retractable engaging means attached to each of said individual carts and movable between an extended position and a retracted position for selectively engaging said endless drive means to move each of said individual carts independently along said guide track when the engaging means is in the extended position;

first means for retracting said engaging means to disengage said engaging means from said drive means to stop each of said individual carts along said guide track; a portion of said first retracting means being mounted on said floor at a location substantially adjacent said guide track;

second means for retracting said guide means to disengage said guide means from said guide track to permit each of said individual carts to be reoriented on said guide track, a portion of said second retracting means being mounted on said floor at a location substantially adjacent said guide track; and pivotal retaining means attached to each of said individual carts for selectively retaining the guide means in the retracted position, said retaining means selectively controlled by a repositioning means.

2. The system of claim 1, wherein said individual cart includes a generally horizontal platform having an upper and a lower surface, and said engaging means comprises a retractable drive pin assembly including a drive pin attached to said lower surface of said platform and extending substantially vertically downwardly.

3. The system of claim 2, further comprising spring means to bias the drive pin to the extended position.

4. The system of claim 3, wherein said first retracting means comprises at least one drive cam roller attached to said drive pin and at least one inclined drive cam mounted on said floor adjacent said guide track that cooperates with said at least one cam roller to retract said drive pin.

5. The system of claim 1, wherein said individual cart includes a generally horizontal platform having an upper and a lower surface, and said guide means comprises a retractable guide pin attached to said lower surface of said platform and extending substantially vertically downwardly.

6. The system of claim 5, further comprising spring means to bias the guide pin to the extended position.

7. The system of claim 6, wherein said second retracting means comprises a guide cam roller attached to said guide pin and an inclined guide cam mounted on said floor adjacent said guide track that cooperates with said guide cam roller to retract said guide pin.

8. The system of claim 1, further comprising repositioning means mounted adjacent said guide track at specified positions to reposition the retaining means at the specified locations.

9. A cart for an endless conveyor system including a guide track to guide the cart and a drive means to move the cart along the guide track, the cart comprising:

an upper platform having a plurality of legs attached thereto;

a lower frame having a generally horizontal upper surface defining a plane and including roller means to roll along the guide track;

a plurality of mounting pins attached to said lower frame for cooperating with said leg means on said upper platform when said upper platform is in a first orientation with said lower frame to support said upper platform in a spaced apart, parallel relation with said plane of said lower frame a first distance above said plane; and second support means on said lower frame for cooperating with said leg means on said upper platform when said upper platform is in a second orientation with said lower frame to support said upper platform in a spaced apart, parallel relation with said plane of said lower frame a second distance above said plane, wherein said first distance is greater than said second distance, and wherein said second support menas includes both a portion of said lower frame that is formed to include openings to receive said plurality of legs and said upper surface of said lower frame that is configured to support said upper platform.

10. A cart for an endless conveyor system including a guide track to guide the cart and a drive means to move the cart along the guide track, the cart comprising:

a frame having roller means to roll along the guide track;

retractable engaging means attached to said cart and movable between an extended position and a retracted position for selectively engaging said drive means when the engaging means is in the extended position to move said cart along said guide track;

retractable guide means separate from said engaging means and attached to said cart and movable between an extended position and a retracted position for selectively engaging said guide track when the guide means is in the extended position to guide said cart along said guide track; and pivotal retaining means attached to said cart for selectively retaining the guide means in the retracted position, said retaining means selectively controlled by repositioning means.

11. The cart of claim 10, wherein said engaging means comprises a drive pin assembly including a drive pin that extends substantially vertically downwardly from said frame.

12. The cart of claim 11, wherein said drive pin assembly further includes spring means to bias the drive pin to the extended position.

13. The cart of claim 10, wherein said guide means comprises a guide pin assembly including a guide pin that extends substantially vertically downwardly from said frame.

14. The cart of claim 13, wherein said guide pin assembly further includes spring means to bias the guide pin to the extended position.

15. An endless conveyor system having individual, rolling, work carrying carts supported on a floor, each cart including a generally horizontal platform having an upper and a lower surface, the conveyor system comprising, a guide track mounted in the floor, an endless drive means in said guide track, a retractable guide pin attached to said lower surface of said platform and extending substantially vertically downwardly and movable between an extended position and a retracted position for engaging said guide track to guide said carts along said guide track when the guide pin is in the extended position, spring means for biasing the guide pin into the extended position, retractable engaging means attached to said individual carts and movable between an extended position and a retracted position for selectively engaging said drive means to move said individual carts along said guide track when the engaging means is in the extended position, first means for retracting said engaging means to disengage said engaging means from said driving means to stop said individual carts along said guide track, a guide cam roller attached to said guide pin, an inclined guide cam mounted adjacent said guide track that cooperates with said guide cam roller to retract said guide pin to disengage said guide pin from said guide track to displace said cart from said guide track, retaining means attached to said individual carts for selectively retaining the guide pin in the retracted position, and respositioning means mounted adjacent said guide track at specified locations to reposition the retaining means at the specified location.

* * * * *